US006907210B2

(12) United States Patent
Wazana et al.

(10) Patent No.: US 6,907,210 B2
(45) Date of Patent: Jun. 14, 2005

(54) REMANUFACTURED TONER CARTRIDGE HAVING MODIFIED ROLLER SECTION

(75) Inventors: Yoel Wazana, Northridge, CA (US); Jesus Gonzalez, Canoga Park, CA (US)

(73) Assignee: Wazana Brothers International, Inc., Chatsworth, CA (US)

( * ) Notice: Subject to any disclaimer, the term of this patent is extended or adjusted under 35 U.S.C. 154(b) by 0 days.

(21) Appl. No.: 10/660,918

(22) Filed: Sep. 13, 2003

(65) Prior Publication Data

US 2005/0058469 A1 Mar. 17, 2005

(51) Int. Cl.[7] ..... G03G 15/00; G03G 15/08; G03G 21/00

(52) U.S. Cl. ..... 399/109; 399/284; 399/350; 399/351

(58) Field of Search ..... 399/109, 111, 399/115, 116, 119, 284, 274, 343, 345, 350, 351

(56) References Cited

U.S. PATENT DOCUMENTS

| | | | |
|---|---|---|---|
| 5,115,275 A | 5/1992 | Suzuki | |
| 6,141,514 A | 10/2000 | Inaba et al. | |
| 6,301,461 B1 | 10/2001 | Sirejacob | |
| 6,484,001 B1 | 11/2002 | Sirejacob | |
| 6,577,830 B1 | 6/2003 | Wazana et al. | |
| 6,587,657 B2 | 7/2003 | Sirejacob | |
| 6,684,039 B1 | 1/2004 | Wazana et al. | |
| 6,763,209 B2 * | 7/2004 | Higeta et al. | 399/109 |
| 2001/0026706 A1 | 10/2001 | Sirejacob | |

* cited by examiner

*Primary Examiner*—Hoang Ngo
(74) *Attorney, Agent, or Firm*—Coudert Brothers LLP; Brian F. Drazich; Jon E. Hokanson

(57) ABSTRACT

A remanufactured laser printer toner cartridge incorporates a used doctor blade and/or a used wiper blade. The used doctor blade has been adapted and oriented to make contact with a developer roller or a magnetic roller along a previously unused portion of the doctor blade's metering surface to utilize a new fresh metering surface. The used wiper blade has been adapted and oriented to make contact with a photoconductive drum along a previously unused portion of the wiper blade's wiping surface to utilize a new fresh wiping surface. The invention extends the effective life of doctor blades and wiper blades by utilizing previously unused working surfaces.

It is emphasized that this abstract is provided to comply with the rules requiring an abstract that will allow a searcher or other reader to quickly ascertain the subject matter of the technical disclosure. It is submitted with the understanding that it will not to be used to interpret or limit the scope or meaning of the claims.

4 Claims, 5 Drawing Sheets

REMANUFACTURED TONER CARTRIDGE HAVING MODIFIED ROLLER SECTION

TECHNICAL FIELD

The present invention relates to the field of laser printing toner cartridge remanufacture in which cartridge components such as the wiper blade and/or doctor blade are modified to permit a previously unused working surface of the blade to be utilized. The present invention finds particular application in the remanufacturing industry.

BACKGROUND ART

Among the numerous types of engineered containers manufactured to a high degree of precision common in modern industry, are, for example, toner cartridges for laser printing. In the case of toner cartridges, a high degree of precision in manufacture is necessary for proper operation and good printed image quality. Toner or process cartridges manufactured by original equipment manufacturers typically have new components including the wiper blade and/or doctor blade, depending upon the type of process employed. Similarly, remanufactured toner cartridges typically have aftermarket wiper blades and/or doctor blades.

In a so called laser printing device, laser light "paints" a latent image on a charged rotating photoconductive drum by altering the charge distribution on the surface of the photoconductive drum such that the photoconductive drum attracts charged toner particles to only that portion of its surface having the latent image. The charged toner particles are subsequently transferred from the charged rotating photoconductive drum to a medium such as paper. Thereafter, as the photoconductive drum continues to rotate, any residual toner particles remaining on the photoconductive drum are removed by a wiper blade to assure that the photoconductive drum surface is clean for receipt of the next image. The wiper blade typically has a flexible polymeric working surface that contacts the surface of the rotating photoconductive drum. In the course of the working life of the cartridge, before the supply of toner is exhausted, the surface of the wiper blade in contact with the rotating photoconductive drum wears or erodes reducing the efficiency of the wiper blade to remove residual toner. This wear or erosion of the working surface of the wiper blade eventually will permit residual toner particles to remain on the photoconductive drum through the next image "painting" cycle thus degrading the quality of the next printed image. Heretofore, it has been necessary for a remanufacturer to replace the wiper blade to achieve good printed image quality over the work cycle (i.e., consumption of the entire toner supply of the cartridge) of a remanufactured toner cartridge.

In addition to the wiper blade, toner cartridges typically also include a component referred to in the art as a doctor blade. The doctor blade has a dual propose. First, it serves to meter a uniformly thin layer of toner particles on the surface of a rotating developer roller that has acquired a deposit of toner on its surface. Second, the doctor blade functions to help uniformly charge the toner deposited on the surface of the developer roller. After passing the doctor blade, a portion of the toner on the developer roller is in turn transferred to the surface of the photoconductive drum carrying the latent image to be printed.

In laser printers designed for non-magnetic toners, the doctor blade is electrically charged and in direct contact with the surface of the electrically charged rotating developer roller. In this type of printer, the doctor blade is typically made of a relatively rigid and noncompliant material such as steel. Also, compliant doctor blades having relative stiffness along the direction of the circumference of the developer roller and relative flexibility along the direction of the axis of the developer roller are known, as described in U.S. Pat. No. 5,702,812 to Bracken, et al. The interaction of the charged doctor blade and charged developer roller together with the mechanical forces on the toner particles at the point of contact between the blade and roller results in a uniform thin layer of charged toner particles passing under the doctor blade on the surface of the developer roller.

Central to proper operation of a doctor blade are its surface roughness and wear resistance where it contacts the developer roller. The surface roughness of the doctor blade is a design parameter in the construction of the component. Too smooth a surface where the doctor blade contacts the developer roller allows excessive toner to be metered under the blade. On the other hand, too rough a surface allows too little toner under the blade. In either circumstance, the printed image quality is degraded by such variations in the toner layer.

In laser printers designed for magnetic toners, the doctor blade is typically fabricated with a portion having a working surface composed of a compliant material, such as an elastic polymer. In this type of printer, the electrically negatively charged doctor blade is in direct contact with the surface of a negatively electrically charged rotating magnetic roller to which a deposit of magnetic toner has become attached. As the magnetic roller continues to rotate, the deposited toner accumulates behind the doctor blade. The mechanical interaction between the toner particles results in a negative electrostatic charge accumulation on the toner particles. This results in a uniform thin layer of charged toner particles passing under the doctor blade on the surface of the magnetic roller. After passing the doctor blade, a portion of the toner on the magnetic roller is in turn transferred to the positively charged regions of the surface of the photoconductive drum carrying the latent image to be printed.

The effective life of a doctor blade in a toner cartridge intended for use with non-magnetic toner is limited by the wearing away of its surface roughness where it contacts the developer roller. In the course of a working cycle of a toner cartridge the engineered roughness of the contacting surface is often worn to a degree that its continued use would result in degradation of printed image quality. Similarly, the effective life of a doctor blade in a toner cartridge intended for use with magnetic toner is limited by the erosion of its elastomeric surface where it contacts the magnetic roller. In the course of a working cycle of a toner cartridge the elastomeric surface contacting the magnetic roller is often eroded to a degree that its continued use would result in degradation of printed image quality by allowing excess toner to pass the doctor blade. Thus, it is common practice for a toner cartridge remanufacturer to replace the used doctor blade with an original equipment or aftermarket component. Moreover, a doctor blade, being precision engineered, is a relatively expensive component. Therefore, toner cartridge remanufacturers would find it is desirable to extend the effective life of the doctor blade to more than one working cycle of the toner cartridge.

SUMMARY DISCLOSURE OF EMBODIMENTS OF THE INVENTION

The present invention provides a remanufactured toner cartridge having a modified wiper blade and/or a modified doctor blade.

With respect to the wiper blade, the present invention provides a modified original equipment manufacturer's wiper blade, a modified aftermarket wiper blade or a modified remanufactured wiper blade. A wiper blade is modified and adapted to move the line of contact between the photoconductive drum surface and the surface of the wiper blade to an unused portion of the blade's flexible polymeric working surface. This provides a completely new uneroded surface for wiping the surface of the photoconductive drum.

With respect to the doctor blade, the present invention provides a modified original equipment manufacturer's doctor blade, a modified aftermarket doctor blade or a modified remanufactured doctor blade. A doctor blade is modified and adapted to move the line of contact between the surface of the doctor blade and the surface of the developer roller or magnetic roller to an unused portion of the blade's working surface. This provides a completely new unworn surface to contact the surface of the developer roller or magnetic roller, as the case may be, to provide metering of a uniform layer of toner particles on the surface of the roller comparable to that of a new previously unused doctor blade.

BRIEF DESCRIPTION OF THE DRAWINGS

The nature and scope of the several embodiments of the invention will become apparent from the following detailed description taken in connection with the accompanying drawings, in which.

DESCRIPTION OF THE INVENTION

Figure 1:
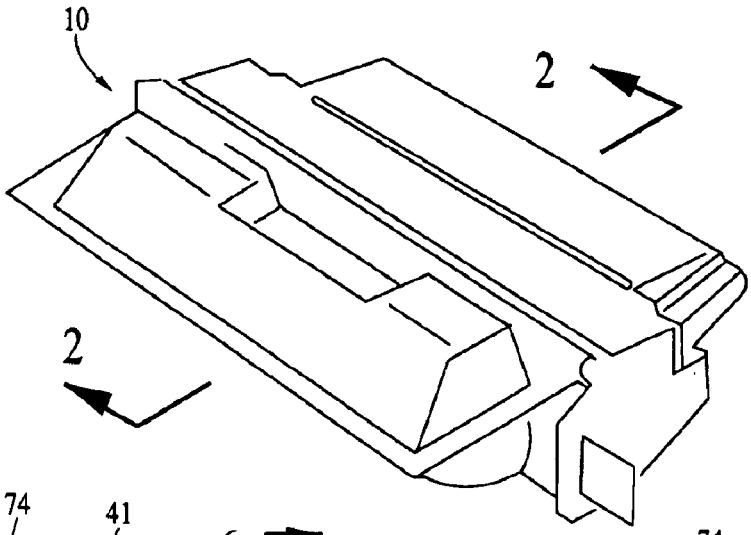
FIG. 1 is a perspective view of a stylized toner cartridge of the kind used in laser printers.
Figure 2:
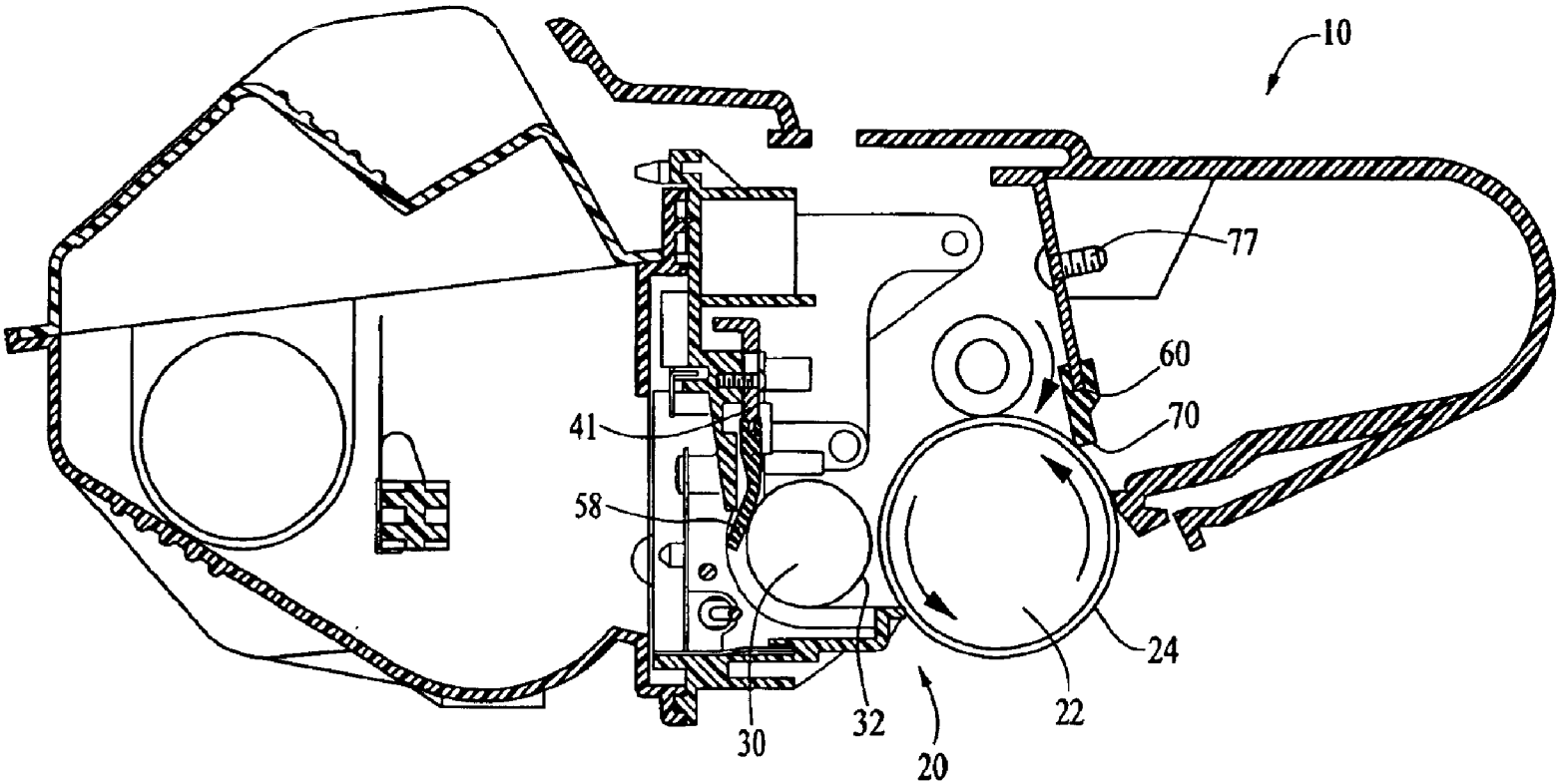
FIG. 2 is a cross-section view through a portion of the FIG. 1 toner cartridge showing a typical arrangement of the photoconductive drum, rollers, a wiper blade and a doctor blade in a toner cartridge.
Figure 3:
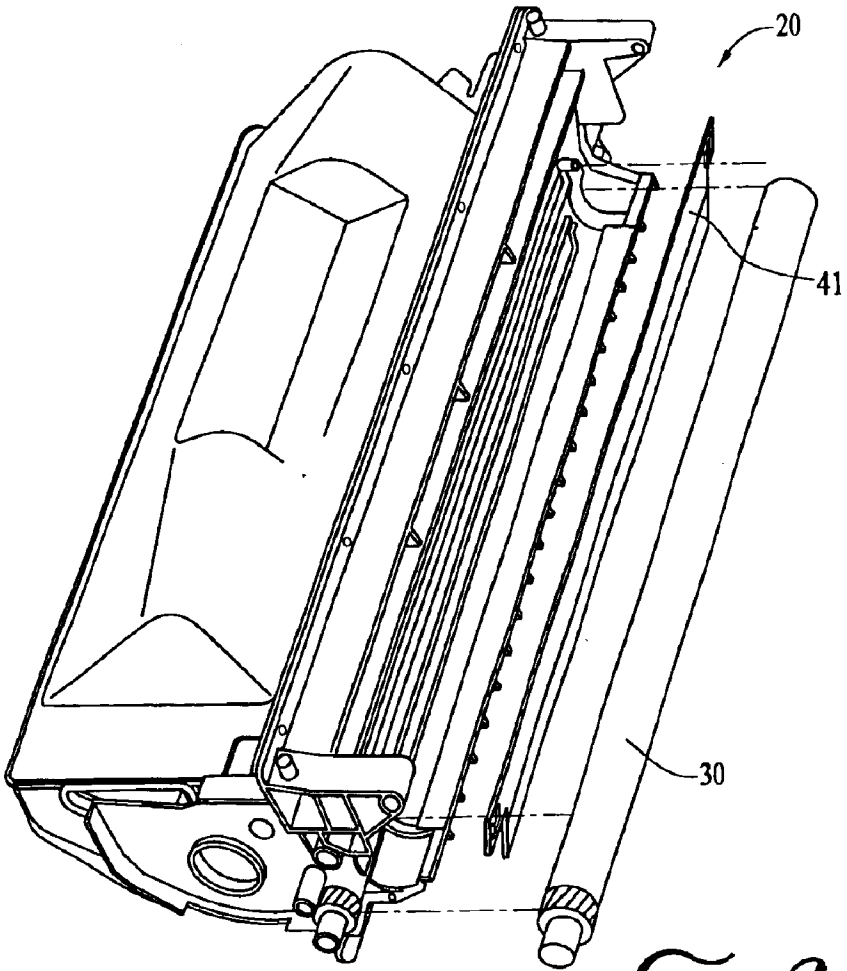
FIG. 3 is a partially disassembled perspective view of a toner cartridge roller section showing the relative positions of a roller and a doctor blade.
Figure 4:
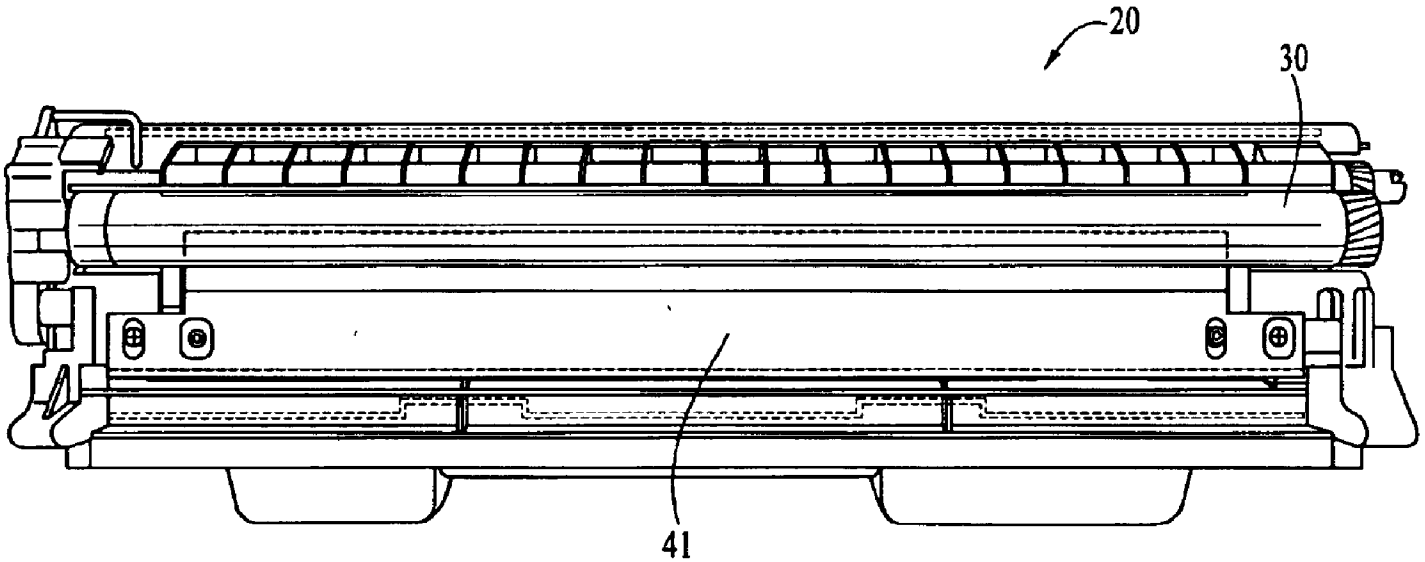
FIG. 4 is a top perspective view of an assembled toner cartridge roller section showing the relative positions of a roller and a doctor blade.

To illustrate and further describe the embodiments of the present invention, reference will be made to FIGS. 1–11. With reference to FIGS. 1 and 2, a typical toner cartridge [10] designed for magnetic toners is shown. The roller section [20] includes a photoconductive drum [22] having a photoconductive surface [24] onto which toner is transferred from the surface [32] of magnetic roller [30]. The doctor blade [41] has a compliant portion [58] typically composed of a flexible polymeric material that presents a planar or curvilinear face [59] that has a contact face [43] portion in direct contact with the surface [32] of the magnetic roller [30].

With further reference to FIG. 2, wiper blade [60] includes a compliant polymeric portion [70] in direct contact with the surface [24] of photoconductive drum [22]. During usage of the supply of toner, the line of contact between the contact face [43] of the doctor blade [41] and the magnetic roller [30], and the line of contact between the contact face [62] of the wiper blade [60] and the surface [24] of the photoconductive drum [22] wears or erodes the respective contacting surfaces of the doctor blade and the wiper blade. As a result, a worn areas [47] and [66] develop along the line of contact on the doctor blade [41] and on the wiper blade [60], respectively. These worn areas [47] and [66] are ineffective to perform the operation for which the doctor blade and wiper blade were designed, if used in a subsequent work cycle of the toner cartridge (i.e., consumption of a recharged toner supply).

The present invention takes advantage of the fact that the planar or curvilinear face [59] of a used doctor blade [41] or the planar or curvilinear face [69] of a used wiper blade [60] has been worn over only a portion of its surface. Thus, the planar or curvilinear face of a used doctor blade or a used wiper blade has unworn areas that have not been in direct contact with a roller [30] or drum [22] and that remain in the same new and unused condition as when the component was first installed. These unworn areas [45] and [64] are effective to perform the operation for which the doctor blade [41] and wiper blade [60], respectively, were designed if used in a subsequent work cycle of the toner cartridge [10].

The various embodiments of the present invention extend the effective life of a doctor blade [40,41] and a wiper blade [60] by utilizing previously unused working surfaces. As will be understood with reference to FIGS. 5–11, a used wiper blade [60] is adapted and oriented to make contact with a photoconductive drum [22] along a previously unused portion of the wiper blade's wiping surface to utilize a new fresh wiping surface on unworn area [64]. Similarly, a used compliant doctor blade [41] is adapted and oriented to make contact with a magnetic roller [30] along a previously unused portion of the doctor blade's contact face [43] to utilize a new fresh metering surface on unworn area [45]. Also, a used rigid doctor blade [40] is adapted and oriented to make contact with a developer roller [26] along a previously unused portion of the doctor blade's contact face [42] to utilize a new fresh metering surface on unworn area [44].

Figure 5:
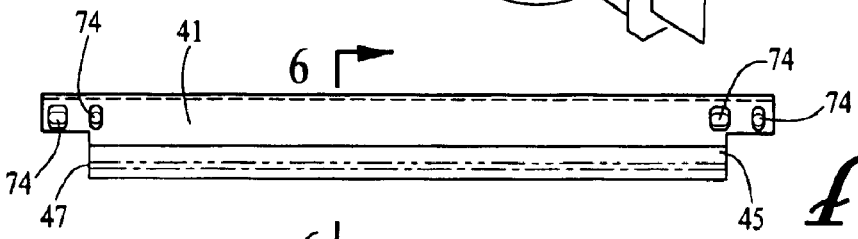
FIG. 5 is a top view of one type of doctor blade of the type used in toner cartridges designed for magnetic toners.
Figure 6:
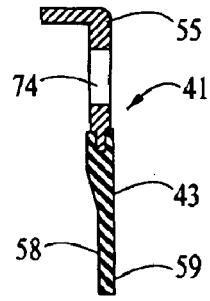
FIG. 6 is a cross-section view through a portion of the FIG. 5 doctor blade.

As shown in FIG. 5, a doctor blade [41] typically includes mounting holes [74] by which the doctor blade is positioned and attached to the roller section [20] of the toner cartridge [10] by screws [75] or other fasteners. As shown in FIGS. 5–8, the mounting holes [74] have been elongated in the present invention as indicated in FIG. 5 by the overlapping ovals and rounded rectangles representing mounting holes [74]. The elongated mounting holes [74] permit the position of the contact face [43] of the planar or curvilinear face [59] of the compliant polymeric portion [58] of doctor blade [41] to be adjusted with respect to the line of contact with the magnetic roller [30] before being secured immovably but removably in place in roller section [20].

It will be clear that other conventional means to position and affix the doctor blade, or wiper blade, such as by adhesive, boring new holes in the mounting portion of the doctor blade or wiper blade and in the roller section for screws or fasteners, ultrasonic welding, or the like as would be known to one of ordinary skill in the art.

Figure 7:
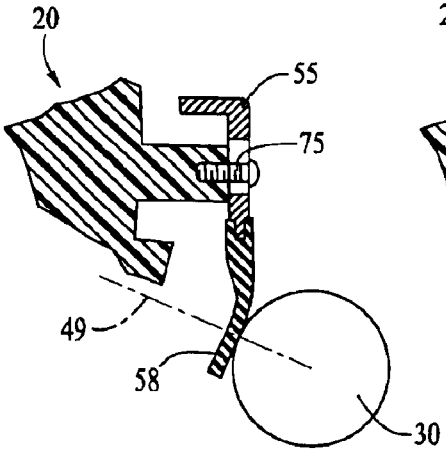
FIG. 7 is a cross-sectional view through a portion of a roller section showing a doctor blade mounted in a first position bearing on a magnetic roller surface.

With particular reference to FIG. 7, the mounting portion [55] of the doctor blade is shown as the doctor blade [41] is originally positioned prior to remanufacture in accord with the present invention. In this original position, the worn area [47] of the polymeric portion [58] of the doctor blade [41] is designated by the line [49] passing through the polymeric portion [58].

Figure 8:
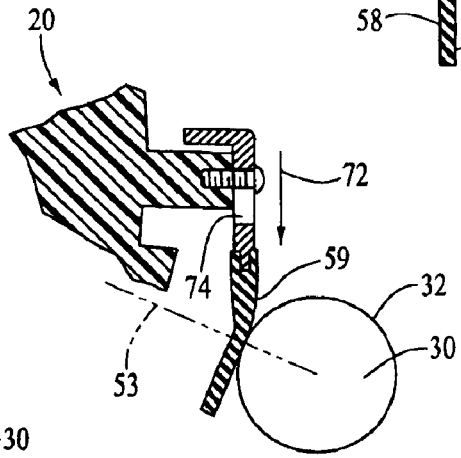
FIG. 8 is a cross-sectional view through a portion of a roller section showing a doctor blade mounted in a second position bearing on a magnetic roller surface.

With particular reference to FIG. 8, the mounting portion [55] of the doctor blade is shown as the doctor blade [41] is positioned in accord with the present invention. In this remanufactured position, an unworn area [45] of the polymeric portion [58] of the doctor blade [41] is designated by the line [53] passing through the polymeric portion [58]. Arrow [72] indicates the change in position of the mounting portion [55] of the doctor blade from its originally installed position to its remanufactured position to bring an unworn area [45] of the planar or curvilinear face [59] into contact with the surface [32] of magnetic roller [30].

The distance between the original position of the doctor blade as shown in FIG. 7 and the remanufactured position of the doctor blade as shown in FIG. 8, for example, is different for each particular brand and model of toner cartridge. It has been determined experimentally that, depending upon the toner cartridge original manufacturer and model, a change in position of the doctor blade from its originally installed position of from about 0.020 inches to about 0.120 inches to a new remanufactured position, as indicated by arrow [72], will yield printed image quality substantially equal to that provided by a new original equipment manufacturer or aftermarket doctor blade.

Figure 9:
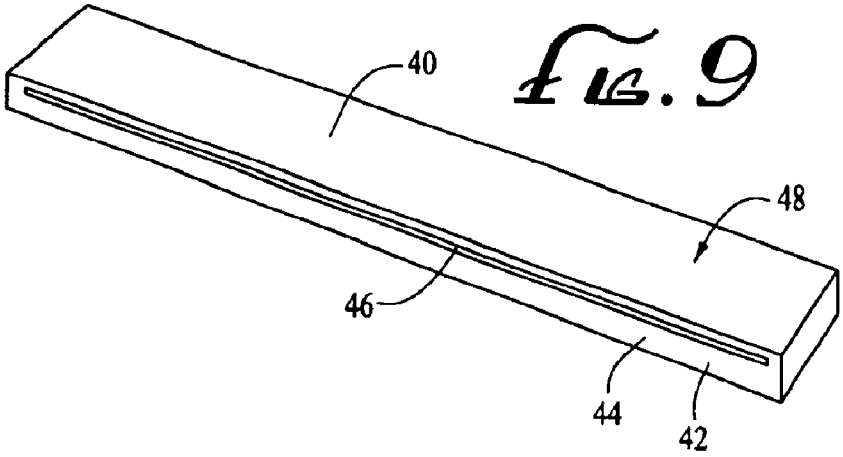
FIG. 9 is a perspective view of a rigid metallic doctor blade of the type used in toner cartridges designed for non-magnetic toners.
Figure 10:
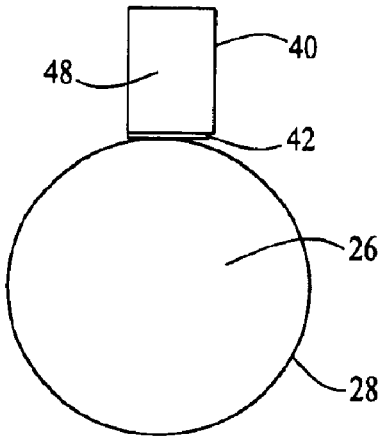
FIG. 10 is a cross-sectional view of a rigid metallic doctor blade in contact with a developer roller.

Now, with reference to FIGS. 9–11, embodiments of the present invention as applied to toner cartridges designed for non-magnetic toner will be discussed. FIG. 9 shows a rigid metallic doctor blade [40] of the type used in a toner cartridge [10] designed for non-magnetic toners. Doctor blade [40] includes contact face [42] having an engineered surface roughness designed to assure that a uniform thin layer of charged toner particles is metered under the doctor blade [40] onto the surface [28] of the developer roller [26]. After use over a work life cycle of a toner cartridge, a worn area [46] will have developed on contact face [42]. This worn area [46] is typically too smooth to provide effective metering of toner for a subsequent work life cycle, and usually in remanufacturing a toner cartridge, the used doctor blade is discarded and replaced with a new component. However, as shown in FIGS. 9 and 10, the position and orientation of the doctor blade ordinarily is such that the worn area [46] extends across only a portion of the width of the contact face [42]. In the present embodiment, doctor blade [40] is repositioned and reinstalled into roller section [20] so that unworn area [44] of contact face [42] is in direct contact with surface [28] of developer roller [26]. This repositioning of doctor blade [40] is accomplished by removing the doctor blade [40] from its retainer in the roller section, flipping it end for end, and reinserting and retaining it in its retainer so that contact face [42] is in direct contact with developer roller [26]. By so doing, doctor blade [40] is adapted and oriented to make contact with developer roller [26] along a previously unused portion of the doctor blade's contact face [42] to utilize a new fresh metering surface on unworn area [44]. It has been determined experimentally that repositioning as described a previously used doctor blade [40] having an unworn area [44] will yield printed image quality substantially equal to that provided by a new original equipment manufacturer or aftermarket doctor blade.

It will be understood by one of ordinary skill in the art that the concept and application of the present invention may be applied to a compliant doctor blade such as of the kind disclosed in U.S. Pat. No. 5,702,812 to Bracken, et al.

Figure 11:
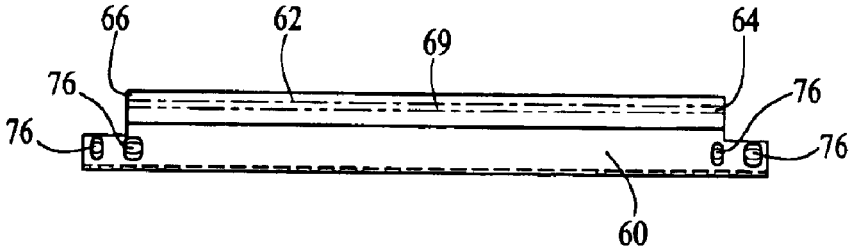
FIG. 11 is a top view of one type of wiper blade used in toner cartridges.

As shown in FIGS. 2 and 11, a wiper blade [60] typically includes mounting holes [76] by which the wiper blade is positioned and attached to the roller section [20] of the toner cartridge [10] by screws [77] or other fasteners. As shown in FIG. 11, the mounting holes [76] have been elongated in the present invention as indicated in FIG. 11 by the overlapping ovals and rounded rectangles representing mounting holes [76]. The elongated mounting holes [76] permit the position of the contact face [62] of the planar or curvilinear face [69] of the compliant polymeric portion [70] of wiper blade [60] to be adjusted with respect to the line of contact with the photoconductive drum [22] before being secured immovably but removably in place in roller section [20].

With reference to FIG. 2, the wiper blade [60] is shown as positioned in accord with the present invention. In this remanufactured position, an unworn area [64] of the polymeric portion [70] of the wiper blade [60] is positioned to bring it into contact with the surface [24] of photoconductive drum [22].

The distance between the original position of the wiper blade and the remanufactured position of the wiper blade [60] as shown in FIG. 2, for example, is different for each particular brand and model of toner cartridge. It has been determined experimentally that, depending upon the toner cartridge original manufacturer and model, a change in position of the wiper blade from its originally installed position of from about 0.010 inches to about 0.100 inches, and a change of the angle of contact as measured from the original angle of contact of from about 0 degrees to about 10 degrees, to a new remanufactured position, will yield printed image quality substantially equal to that provided by a new original equipment manufacturer or aftermarket wiper blade.

While the present invention has been described in connection with what are present considered to be the most practical and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures.

What is claimed is:

1. A remanufactured laser printer toner cartridge having a modified roller section comprising:

a wiper blade having a contact face;

said contact face having a greatest length dimension and a width dimension;

said contact face having at least one unworn area extending along its length and extending along its width;

said contact face having at least one worn area extending along its length and extending along its width;

said at least one worn area extending less than the width of the contact face;

said wiper blade removably secured to said roller section;

said unworn area only of the contact face in direct contact with the surface of a photoconductive drum.

2. A remanufactured laser printer toner cartridge having a modified roller section comprising:

a doctor blade having a contact face;

said doctor blade contact face having a greatest length dimension and a width dimension;

said doctor blade contact face having at least one unworn area extending along its length and extending along its width;

said doctor blade contact face having at least one worn area extending along its length and extending along its width;

said at least one worn area extending less than the width of the doctor blade contact face;

said doctor blade removably secured to said roller section;

said unworn area only of the doctor blade contact face in direct contact with the surface of a developer roller;

a wiper blade having a contact face;

said wiper blade contact face having a greatest length dimension and a width dimension;

said wiper blade contact face having at least one unworn area extending along its length and extending along its width;

said wiper blade contact face having at least one worn area extending along its length and extending along its width;

said at least one worn area extending less than the width of the wiper blade contact face;

said wiper blade removably secured to said roller section;

said unworn area only of the wiper blade contact face in direct contact with the surface of a photoconductive drum.

3. A remanufactured laser printer toner cartridge having a modified roller section comprising:

a doctor blade having a contact face;

said doctor blade contact face having a greatest length dimension and a width dimension;

said doctor blade contact face having at least one unworn area extending along its length and extending along its width;

said doctor blade contact face having at least one worn area extending along its length and extending along its width;

said at least one worn area extending less than the width of the doctor blade contact face;

said doctor blade removably secured to said roller section;

said unworn area only of the doctor blade contact face in direct contact with the surface of a magnetic roller;

a wiper blade having a contact face;

said contact face having a greatest length dimension and a width dimension;

said wiper blade contact face having at least one unworn area extending along its length and extending along its width;

said wiper blade contact face having at least one worn area extending along its length and extending along its width;

said at least one worn area extending less than the width of the wiper blade contact face;

said wiper blade removably secured to said roller section;

said unworn area only of the wiper blade contact face in direct contact with the surface of a photoconductive drum.

4. A remanufactured wiper blade comprising:

a wiper blade having a compliant polymeric portion having a planar or curvilinear face with a surface adapted for dislodging toner particles from the surface of a rotating photoconductive drum;

said planar or curvilinear face having a worn area ineffective to dislodge toner particles from the surface of a rotating photoconductive drum;

said planar or curvilinear face having an unworn area effective to dislodge toner particles from the surface of a rotating photoconductive drum;

means for affixing the wiper blade to the roller section adapted to position said planar or curvilinear face in direct contact with the surface of said photoconductive drum such that only the unworn area of said planar or curvilinear face contacts said photoconductive drum.

* * * * *